US005857865A

United States Patent [19]

Shimirak et al.

[11] Patent Number: 5,857,865

[45] Date of Patent: Jan. 12, 1999

[54] SEALED COAXIAL CABLE CONNECTOR

[75] Inventors: Gerald Shimirak, Palo Alto; Anthony Vranicar, Santa Clara, both of Calif.

[73] Assignee: Raychem Corporation, Menlo Park, Calif.

[21] Appl. No.: 824,533

[22] Filed: Mar. 26, 1997

[51] Int. Cl.[6] ..... H01R 13/52

[52] U.S. Cl. ..... 439/277; 439/320

[58] Field of Search ..... 439/320, 321, 439/322, 462, 583, 584, 277; 285/32, 52, 53, 80, 133.21, 133.4, 288.6, 290.3, 291.1, 392, 403; 411/915, 947

[56] References Cited

U.S. PATENT DOCUMENTS

| | | | |
|---|---|---|---|
| 3,373,243 | 3/1968 | Janowiak et al. | 174/89 |
| 3,564,118 | 2/1971 | Becker . | |
| 4,156,554 | 5/1979 | Aujla | 439/584 |
| 4,408,822 | 10/1983 | Nikitas . | |
| 4,869,679 | 9/1989 | Szegda | 439/277 |
| 5,052,946 | 10/1991 | Homolka | 439/584 |
| 5,571,028 | 11/1996 | Szegda | 439/322 |

FOREIGN PATENT DOCUMENTS

| | | |
|---|---|---|
| 1282715 | 7/1972 | United Kingdom . |

*Primary Examiner*—Neil Abrams
*Assistant Examiner*—Brian J. Biggi
*Attorney, Agent, or Firm*—Herbert G. Burkard

[57] ABSTRACT

A sealed F-connector, with a threaded section and a recessed section adjacent the threaded section, has a ring-shaped elastomeric sealing member formed within the recessed section and affixed to the surface of the recessed section. When a connector shell from a mating connector is screwed on, the sealing member deforms as the connector shell screws on over the sealing member, thereby lining at least a portion of the internal thread of the connector shell and at least a portion of the recessed section of the F-connector. The deformed sealing member thereby establishes a barrier to the penetration of moisture between the F-connector and the mating connector.

10 Claims, 2 Drawing Sheets

SEALED COAXIAL CABLE CONNECTOR

BACKGROUND OF THE INVENTION

1. Field of the Invention

This invention relates to coaxial cable connectors.

2. Introduction to the Invention

A connector commonly used in coaxial cable systems is known as the F-connector. The F-connector is typically found on cables and devices from a cable tap at a distribution cable to equipment at a subscriber's premises. A male F-connector is typically used to terminate a coaxial cable. An F-connector having a female F-port may be used to connect a coaxial cable to a device, e.g. to a cable tap, splitter, etc. An F-connector having two female ports may be used to join two coaxial cables together. Because F-connectors are used in such large quantities, it has been necessary to develop F-connectors which are easily assembled and inexpensive. As used herein, the terms female connector, female F-port and F-port are considered synonymous.

A wire connecting the distribution cable to a subscriber's premises is commonly referred to as a dropwire. The dropwire is typically terminated with male F-connectors at both ends and connects to a female F-port at the cable tap and a female F-port at the subscriber's premises. In residential installations, it is common for the dropwire to connect to an F-port on a ground block which may be mounted to an outside wall of the subscriber's residence. Additional F-ports and male F-connectors may also be employed, e.g., with splitters, wall plates, and other devices, and associated cabling used to condition and distribute the cable signals to equipment located within the subscriber's premises.

The connections between the cable tap F-ports and the dropwire F-connectors, as well as connectors on other cabling and equipment situated outside, are all subject to attack from the elements, particularly ingress by moisture from rain and conditions of high relative humidity. In areas where this has posed a problem, attempts have been made to seal such connections. One means of sealing employs an elastic sealing sleeve which is first slipped over the end of the cable, and then, after the connectors are joined, the sleeve is repositioned over the connectors. Another means employs a ring-shaped compression gasket which fits around the female connector, and, upon screwing the male connector shell on the female connector, the compression washer forms a seal between the leading edge of the connector shell and an opposing face of the female connector. However, such compression washers can turn with the connector shell as the connector shell is screwed on, and provide a leak path through the center hole in the washer, between the washer and the outer surface of the connector. These approaches have provided some measure of protection for connections used in cable systems to date. However, they only provide a very modest sealing capability, and, in particular, do not adequately seal the threaded sections of the mating connectors. Moreover, with distribution cables and cable taps typically carried high above ground, it can be cumbersome for the craft person to install such sealing devices.

In another approach, a sealant element is contained within the connector shell. The sealant element deforms when the connector shell is screwed onto the threaded female connector. However, connector shells made by different manufacturers vary in certain dimensions, particularly with respect to the depth of the connector shell and the number of threads. Thus the effectiveness of the sealant may vary depending on the compatibility of the female connector with the connector shell on the male connector, and whether the craft person adequately tightens the connector shell on the female connector. In another approach, the sealant element may be a cylindrical sleeve which is compressed between the mating threads of the two connectors. However, such sleeves can require replacement upon reentry, which may also be a cumbersome task for the craft person.

It is also known to apply a liquid or strand-like sealing material to one or both of the threads of the mating parts prior to screwing on the connector shell. However, the integrity of the resulting seal is dependent upon the care with which the sealing material is applied, and is often neglected by craft persons under stressful or poor climate conditions.

With higher bandwidth and digital signals being introduced, and with cable systems beginning to carry power to the subscriber, there is a need in the cable television industry to provide an effective means of sealing coaxial cable connectors to resist signal degradation. There is likewise a need to provide a means of sealing such connectors which means is not cumbersome or dependent on the skill of the craft person. There is also a need to provide such a sealing means which is integral to the coaxial cable connectors to simplify the installation of the sealing means.

SUMMARY OF THE INVENTION

We have now discovered a means for sealing coaxial cable connectors which provides an effective seal against moisture ingress, seals the threaded sections of the mating connectors, and is integral to the coaxial cable connector.

In a first aspect, the invention provides an electrical connector configured and dimensioned to accept in threaded engagement a mating connector, the mating connector having an internally threaded rotatable connector shell, the electrical connector comprising:

a. an elongate, hollow barrel comprising
   (1) an first external threaded section adjacent a first end of the barrel, and
   (2) an first external recessed section adjacent the first threaded section; and
b. a first ring-shaped sealing member seated within and axially affixed to the first external recessed section of the barrel, the first sealing member deformable into a configuration lining at least a portion of the internal thread of the connector shell and at least a portion of the first recessed section of the electrical connector, to thereby establish a barrier to the penetration of moisture between the electrical connector and the mating connector.

In a second aspect, the invention provides an electrical connector of the first aspect of the invention, comprising:

a. a second external threaded section adjacent a second end of the barrel;
b. a second external recessed section adjacent the second threaded section; and
c. a second ring-shaped sealing member seated within and axially affixed to the second external recessed section.

Thus, as a connector shell from a mating connector is screwed on to a female F-port of the invention, the sealing member deforms under the threads of the advancing connector shell, thereby forming a seal between the surface of the recessed section of the F-port and the threads of the connector shell. The sealing member also mounds up in front of the leading edge of the connector shell, likewise forming a seal between the front edge of the connector shell and the surface of the recessed section of the connector barrel.

The integral sealing member may be formed by insert molding or any other suitable means which results in the sealing member being axially affixed to the surface of the recessed section of the connector barrel so that the sealing member does not turn with a connector shell being screwed onto the female F-port. The surface of the recessed section may be roughened to facilitate a good bond between the sealing member and the connector barrel.

The sealing member comprises an elastomeric sleeve that encircles the outer diameter of the barrel connector at a point just past the male threadform. This material may be a crosslinked rubber (natural or synthetic) e.g., Buna-N, EPDM, Neoprene, and Silicone; a thermoplastic rubber, e.g. Kraton and Santoprene, or a firm gel. The elastomer should tightly adhere to the barrel or metal substrate, as it must resist the tendency to unroll or peel back as the mating connector is installed. The adhesion can be improved by several means. The surface of the connector can be mechanically knurled before the elastomer is applied in manufacture. Chemical treatment of the substrate may also be used to promote adhesion. Actual application of the sealing sleeve in manufacturing could be accomplished by overmolding of the elastomer onto the connector barrel (in which the connector is placed into the mold, and material is made to melt and flow into the proper location and shape).

In preferred embodiments of the invention, the threaded section of the F-port comprises threads having a major diameter, $D_{MA}$, and a minor diameter, $D_{MI}$; the sealing member has a leading edge which faces the threaded section, and which has a diameter, $D_{SL}$; and $D_{SL}$ is less than $D_{MI}$. It is preferred that the leading edge of the sealing member have a diameter which is less than the minor diameter of the threaded section so that an advancing connector shell from a mating connector will screw on over the sealing member. Otherwise, the connector shell would tend to simply pick up and push the sealing member, thereby likely breaking the sealing member free from the surface of the connector barrel and pushing it out of position.

The actual seal is formed when the mating connector shell is threaded onto the barrel. As the connector shell is tightened, the leading internal threads of the connector shell pass beyond the threads on the barrel and encounter the elastomeric sleeve. As the threads continue they meet resistance from the elastomer, which will deform to fill the thread ridges and grooves. The ability of the elastomer to fill the crevices will depend on its hardness (e.g., as measured by Durometer) and the compression of the connector shell onto the elastomer. The connector shell threads may also cut into and form threads onto the sealing material. This effect can produce a tighter seal in that the elastomer forms a much closer match to the thread shape. However, the tear resistance should be such that the threads cut and remove material without tearing the material apart. As mentioned before, the adhesion of the elastomer should be strong enough to allow the material to deform without breaking loose from the substrate and producing a leak path at the interface.

The shape of the elastomeric seal will be such that it tends to bulge up against the leading face of the female connector, forming a seal at this location as well as on the internal threads. In a preferred embodiment, the sealing member has a concave arcuate cross section. However, other suitable cross sections having a leading edge which is less than the minor diameter of the threaded section are also contemplated.

The quality of the seal over time will be determined in part by the elastomer's resistance to compression set, or loss of energy over time. Other factors such as resistance to ultraviolet light and effects of low and high temperatures on the elastomer's physical properties will also affect the seal quality.

The recessed section may have an annular step formed at each end of the section to facilitate the molding process.

BRIEF DESCRIPTION OF THE DRAWINGS

For a better understanding of the nature and objects of the invention, reference should be had to the following detailed description of the preferred embodiments of the invention, taken in conjunction with the accompanying drawings, in which like components are given the same reference numerals in each FIG. in which they appear, and in which.

Note that none of the drawings are to scale.

DETAILED DESCRIPTION OF THE INVENTION

Figure 5:
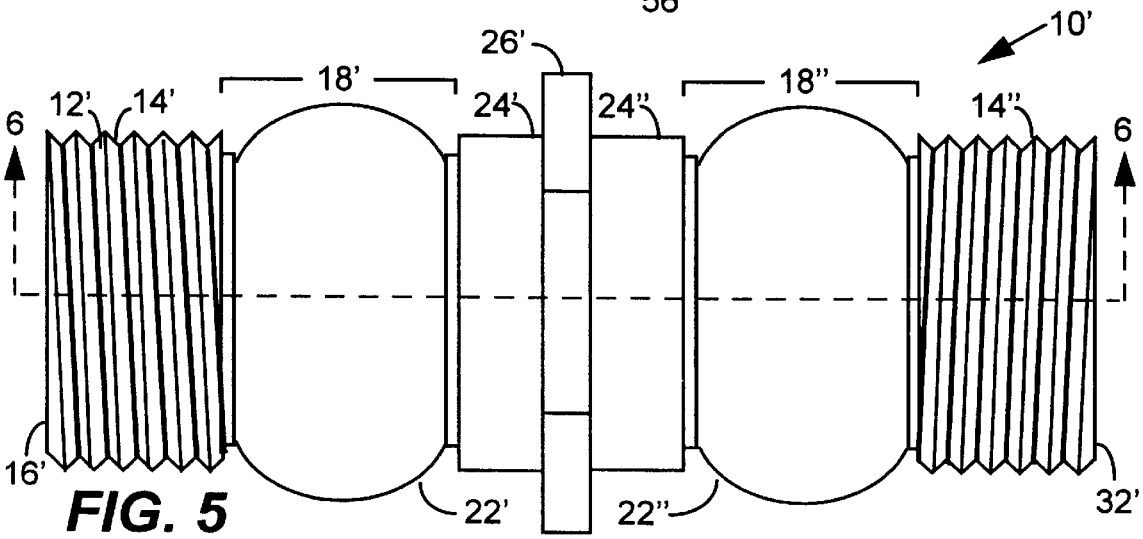
FIG. 5 is a plan view of an embodiment of a dual-ended barrel housing of a coaxial connector of the invention.
Figure 6:
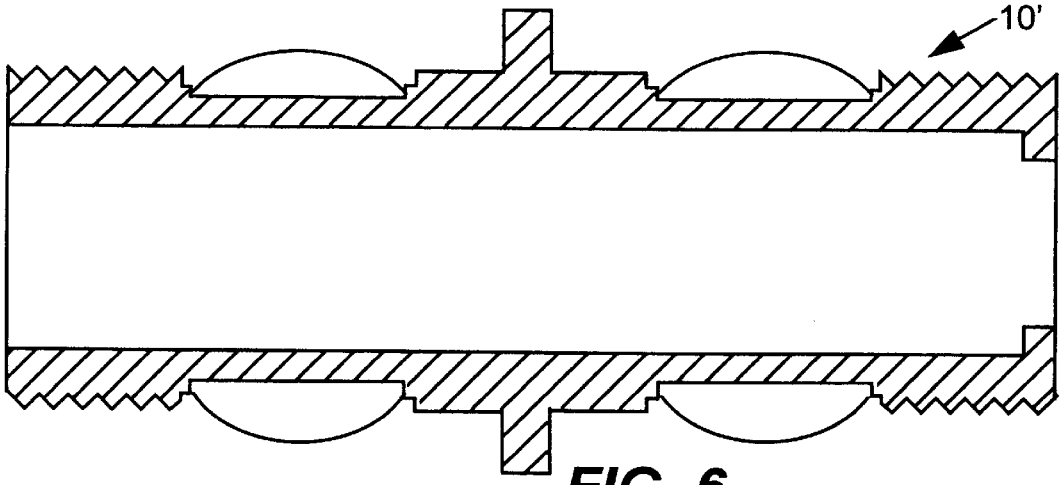
FIG. 6 is a cross sectional view of the embodiment of a dual-ended barrel housing depicted in FIG. 5, taken along the plane 6—6.

To simplify the description of the invention as illustrated in the embodiments depicted herein, certain components which are not pertinent to the invention, e.g., conductive center contact, dielectric insert, and the like, are not illustrated in the FIGS. Also, for purposes of illustration, the barrel housings depicted in the FIGS. 1–4 are representative of a barrel housing of a coaxial cable connector which might be affixed to an equipment chassis, a cable tap, or the like. Such connectors will be referred to herein as single-ended connectors, referring to the fact that the connector connects to a mating coaxial cable connector on one end only. A coaxial cable connector suitable for connecting to two mating connectors, e.g. to join two coaxial cables, is illustrated in FIGS. 5 and 6. Those skilled in the art are aware that there is a variety of configurations of single-ended connectors and dual-ended connectors (e.g. location, along the length of the connector, of an integral hexagonal nut; inclusion of an integral round grooved-edge nut; etc.), and will recognize that the invention disclosed herein is not limited to the particular configurations illustrated in the FIGS.

Figure 1:
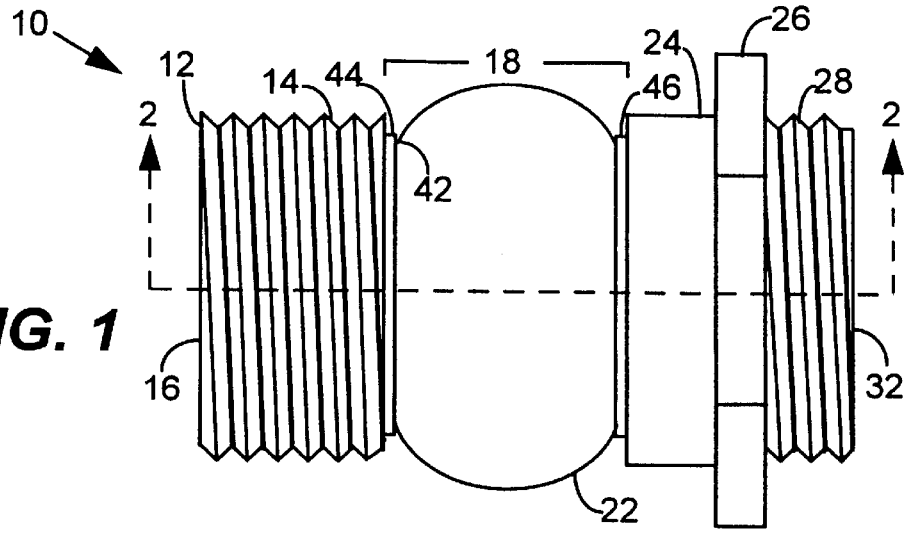
FIG. 1 is a plan view of an embodiment of a barrel housing of a coaxial cable connector of the invention.

FIG. 1 is a plan view of an embodiment of a barrel housing 10 of a coaxial cable connector of the invention. The barrel housing 10 comprises an elongate hollow barrel body 12. The barrel body 12 comprises an anterior external threaded section 14 adjacent a first end 16 of the barrel body 12, and a recessed section 18 adjacent the anterior threaded section 14. Seated within and axially affixed to the recessed section 18 is a ring-shaped sealing member 22. Additional features illustrated include a cylindrical section 24 adjacent the recessed section 18, an integral hexagonal nut 26 adjacent the cylindrical section 24, and a posterior external threaded section 28 adjacent the hexagonal nut 26, the posterior threaded section 28 terminating in a second end 32 of the barrel body 12. First and second annular steps 44, 46 are formed at the two ends of the recessed section 18 to facilitate the molding of the sealing member 22 by providing a uniform surface against which the mold may close.

Figure 2:
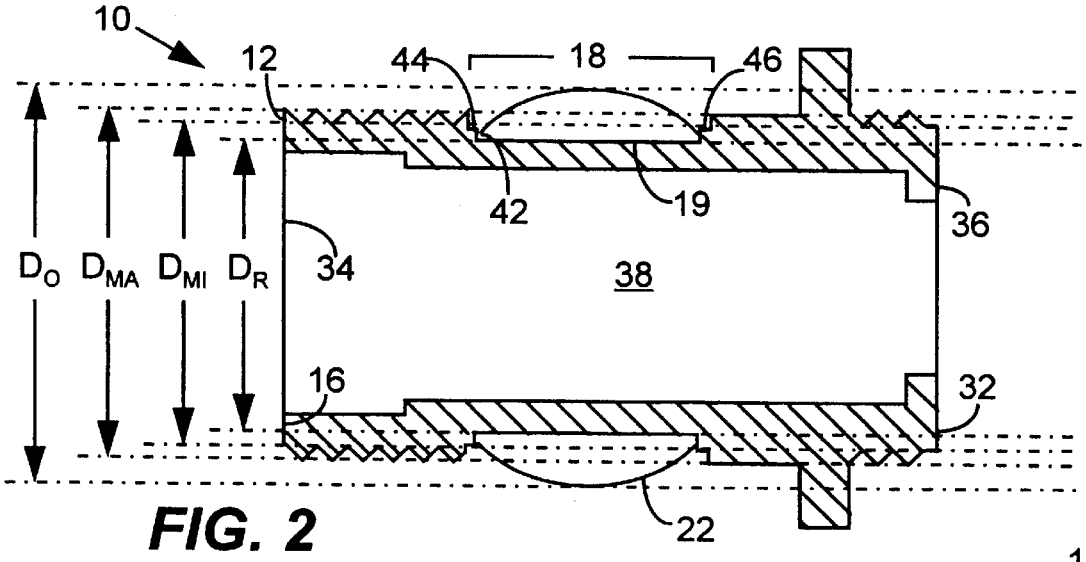
FIG. 2 is a cross sectional view of the embodiment of a barrel housing depicted in FIG. 1 taken along the plane 1—1.

FIG. 2 is a cross sectional view of the embodiment of a barrel housing 10 depicted in FIG. 1, taken along the plane 2—2. The first end 16 of the barrel body 12, comprises a cylindrical aperture 34 through which internal components (not illustrated) may be inserted into the barrel body 12. At the second end 32, the barrel body 12 may have a radially inwardly directed annular flange 36 which is sized to retain a dielectric insert (not illustrated) within the hollow interior 38 of the barrel body 12. Typically, after internal components are inserted into the barrel body 12, the first end 16 may be rolled or suaged to form a radially inwardly directed annular lip (not illustrated) to retain components within the barrel body 12.

In the anterior threaded section 14, the threads have a major diameter, $D_{MA}$, and a minor diameter $D_{MI}$. In the recessed section 18, the barrel body 12 has a recessed diameter, $D_R$. The sealing member 22 is comprised of a nonmetallic yieldably deformable material which may be insert molded or otherwise formed to secure the sealing member 22 to a surface 19 of the recessed section 18. The sealing member 22 has a leading edge 42. In preferred embodiments the leading edge 42 of the sealing member 22 has a diameter which is substantially equal to $D_R$, and it is preferred that the diameter of the leading edge 42 of the sealing member 22 be less than the minor diameter of the anterior threaded section 14, i.e. that $D_R$ be less than $D_{MI}$. This will be discussed with regard to FIGS. 3 and 4. Although not pertinent to the invention, the threads in the posterior threaded section 28 will typically have the same dimensions as the threads in the anterior threaded section 14. However, the anterior threaded section 14 and posterior threaded section 28 need not have the same number of threads. Also shown are the first and second annular steps 44, 46 formed at the two ends of the recessed section. In one embodiment, the first and second annular steps 44, 46 have a width dimension of at least 0.025 inches and rise approximately 0.025 inches above the surface 19 of the recessed section 18.

In one embodiment, the sealing member 22 has a concave arcuate cross section, and has an outer diameter, $D_O$. In preferred embodiments, the outer diameter of the sealing member 22 is greater than the major diameter of the anterior threaded section 14, i.e. $D_O$ is greater than $D_{MA}$.

Figure 3:
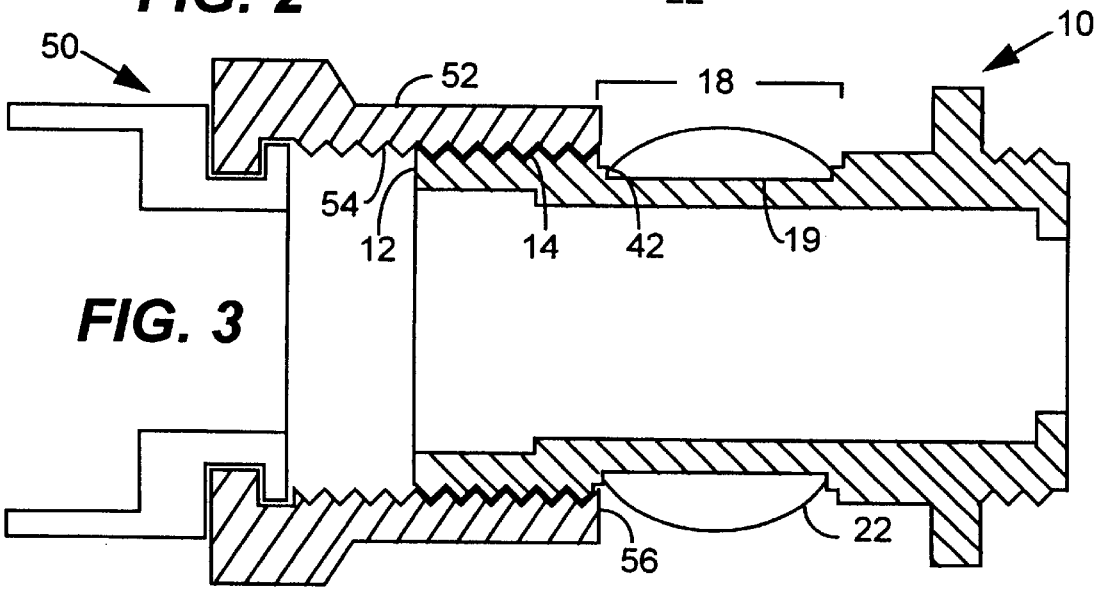
FIG. 3 is a cross sectional view of the barrel housing depicted in FIG. 1 mating with a mating connector having an internally threaded connector shell.
Figure 4:
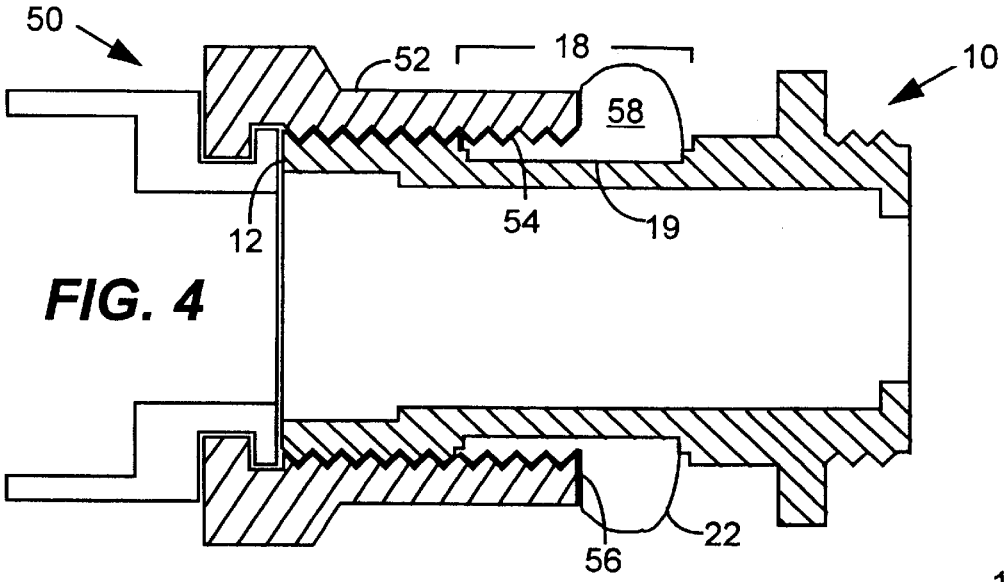
FIG. 4 is a cross sectional view of the barrel housing and mating connector depicted in FIG. 3, fully mated.

FIGS. 3 and 4 are cross sectional views of the barrel housing 10 depicted in FIGS. 1 and 2, mating with a mating connector 50 having an internally threaded connector shell 52. In the illustrations of both FIGS. 3 and 4, only those features of the mating connector 50 are depicted which are pertinent to describe the invention. A connector shell 52 is internally threaded with threads 54 which mate with the threads on the anterior threaded section 14 of the barrel body 12. As depicted in FIG. 3, the connector shell 52 is partially mated with the barrel body 12, and a leading edge 56 of the connector shell 52 is poised to come into contact with the sealing member 22 upon further advancement (i.e., screwing on) of the connector shell 52. As indicated above, it is preferred that the leading edge 42 of the sealing member 22 have a diameter, $D_R$, which is smaller than the minor diameter, $D_{MI}$, of the anterior threaded section 14. If the minor diameter of the threaded section 14 were smaller than the diameter of the leading edge 42 of the sealing member 22, then, as the connector shell 52 on the mating connector 50 is turned to advance the connector shell 52 on the barrel body 12, the connector shell 52 would tend to simply push against the sealing member 22. This could have an effect of, e.g., inhibiting the ability to screw the connector shell 52 sufficiently to fully mate the two connectors; breaking the sealing member 22 free from the surface 19 of the recessed section 14; or otherwise causing a poor or unsealed connection between the two connectors.

As depicted in FIG. 4, the connector shell 52 and barrel body 12 are fully mated, i.e. the connector shell 52 is screwed on and tightened to the barrel body 12. The sealing member 22 has deformed under the advancement of the connector shell 52, filling any gap between the surface 19 of the recessed section 18 and the threads 54 of the connector shell 52. The deformation of the sealing member 22 resulting from the advancement of the connector shell 52 has also caused the sealing member 22 to mound 58 and thereby seal against the leading edge 56 of the connector shell 52. The invention thus provides for an effective moisture seal between the connector shell 52 and the barrel housing 12.

Connector shells 52 provided by different manufacturers are known to vary in certain respects, e.g., the number of threads. A female coaxial cable connector of the invention may be sized to mate with a specific male connector and connector shell, or the combination of the anterior threaded section 14 and the recessed section 18 of the connector body 12 may be sized to mate with connector shells 52 having numbers of threads falling within a fairly wide range, thereby providing a female coaxial cable connector suitable for forming a sealed connection with any one of many known male coaxial connectors. In the latter instance, the number of threads in the anterior threaded section 14 of the barrel housing 12 of the female connector should be small enough to insure that, upon mating, a mating connector shell 52 will extend past the anterior threaded section 14 and into, but not past, the recessed section 18, as depicted in FIG. 4.

FIG. 5 is a plan view of an embodiment of a dual-ended barrel housing 10' of a coaxial connector of the invention. FIG. 6 is a cross sectional view of the dual-ended barrel housing 10' depicted in FIG. 5. In the embodiment shown, the dual-ended barrel housing 10' comprises a dual-ended barrel body 12'. The dual-ended barrel body 12' comprises a first threaded section 14' adjacent a first end 16' of the dual-ended barrel body 12'; a first recessed section 18' adjacent the first external threaded section 14'; and a first cylindrical section 24' adjacent the first recessed section 18'. Seated within and axially affixed to the first recessed section 18' is a first ring-shaped sealing member 22'. Similarly situated, and in corresponding order, the dual-ended barrel body 12' comprises a second external threaded section 14" adjacent a second end 32' of the barrel body 12'; a second recessed section 18" adjacent the second external threaded section 14"; and a second cylindrical section 24" adjacent the second recessed section 18". Juxtaposed between the first and second cylindrical sections 24' 24" is an integral hexagonal nut 26'.

The foregoing detailed description of the invention includes passages which are chiefly or exclusively concerned with particular parts or aspects of the invention. It is to be understood that this is for clarity and convenience, that a particular feature may be relevant in more than just the passage in which it is disclosed, at that the disclosure herein includes all the appropriate combinations of information found in the different passages. Similarly, although the various figures and descriptions herein relate to specific embodiments of the invention, it is to be understood that where a specific feature is disclosed in the context of a particular figure, such feature can also be used, to the extent appropriate, in the context of another figure, in combination with another feature, or in the invention in general.

Further, while the present invention has been particularly described in terms of certain preferred embodiments, the invention is not limited to such preferred embodiments. Rather, the scope of the invention is defined by the appended claims.

We claim:

1. An electrical connector configured and dimensioned to accept in threaded engagement a mating connector, the mating connector having an internally threaded rotatable connector shell, the electrical connector comprising:

a. an elongate, hollow barrel comprising:

(1) an first external threaded section adjacent a first end of the barrel; and (2) an first external recessed section adjacent the first threaded section; and b. a first ring-shaped sealing member seated within and axially affixed to the first external recessed section of the barrel, the first sealing member deformable into a configuration lining at least a portion of the internal thread of the connector shell and at least a portion of the first recessed section of the electrical connector, to thereby establish a barrier to the penetration of moisture between the electrical connector and the mating connector, wherein the first external threaded section comprises threads having a major diameter, $D_{MA}$, and a minor diameter, $D_{MI}$; and the first sealing member has a leading edge which faces the threaded section, and which has a diameter, $D_{SL}$, wherein $D_{SL}$ is less than $D_{MI}$.

2. A connector according to claim 1 wherein the first sealing member has an outer diameter, $D_{SO}$, wherein $D_{SO}$ is greater than $D_{MA}$.

3. A connector according to claim 1 wherein the first sealing member has cross-section having a concave arcuate shape.

4. A connector according to claim 1 comprising:

a. a second external threaded section adjacent a second end of the barrel;

b. a second external recessed section adjacent the second threaded section; and c. a second ring-shaped sealing member seated within and axially affixed to the second external recessed section.

5. A connector according to claim 1 wherein the sealing member is selected from the group comprised of:

a. a crosslinked rubber;

b. a thermoplastic rubber; and c. a firm gel.

6. An electrical connector configured and dimensioned to accept in threaded engagement a mating connector, the mating connector having an internally threaded rotatable connector shell, the electrical connector comprising:

a. an elongate, hollow barrel comprising:

(1) an first external threaded section adjacent a first end of the barrel; and (2) an first external recessed section adjacent the first threaded section; and b. a first ring-shaped sealing member seated within and axially affixed to the first external recessed section of the barrel, wherein the first ring-shaped sealing member in an unstressed state has a substantially concave arcuate cross-section and an opposing planar portion that is positioned in the recessed first external section and is deformable into a configuration lining at least a portion of the internal thread of the connector shell and at least a portion of the first recessed section of the electrical connector, to thereby establish a barrier to the penetration of moisture between the electrical connector and the mating connector.

7. A connector according to claim 6 wherein:

a. the first external threaded section comprises threads having a major diameter, $D_{MA}$, and a minor diameter, $D_{MI}$; and b. the first sealing member has a leading edge which faces the threaded section, and which has a diameter, $D_{SL}$, wherein $D_{SL}$ is less than $D_{MI}$.

8. A connector according to claim 6, wherein the first sealing member has an outer diameter, $D_{SO}$, wherein $D_{SO}$ is greater than $D_{MA}$.

9. A connector according to claim 6 comprising:

a. a second external threaded section adjacent a second end of the barrel;

b. a second external recessed section adjacent the second threaded section; and c. a second ring-shaped sealing member seated within and axially affixed to the second external recessed section.

10. A connector according to claim 6, wherein the sealing member is selected from the group comprised of:

a. a cross-linked rubber;

b. a thermoplastic rubber; and c. a firm gel.

* * * * *